US007228808B1

(12) United States Patent
Anderson

(10) Patent No.: US 7,228,808 B1
(45) Date of Patent: Jun. 12, 2007

(54) BATTERY-OPERATED SEWING MACHINE

(75) Inventor: Martin L. Anderson, Maple Lake, MN (US)

(73) Assignee: National Carpet Equipment, Inc., Brooklyn Park, MN (US)

( * ) Notice: Subject to any disclaimer, the term of this patent is extended or adjusted under 35 U.S.C. 154(b) by 0 days.

(21) Appl. No.: 11/031,404

(22) Filed: Jan. 7, 2005

(51) Int. Cl.
*D05B 1/00* (2006.01)

(52) U.S. Cl. ..... 112/169

(58) Field of Classification Search ..... 112/470.12, 112/470.13, 169, 80.03, 220
See application file for complete search history.

(56) References Cited

U.S. PATENT DOCUMENTS

| | | | | | |
|---|---|---|---|---|---|
| 3,745,950 | A | * | 7/1973 | Kato | 112/169 |
| 3,834,333 | A | * | 9/1974 | Seyama | 112/169 |
| 3,837,306 | A | * | 9/1974 | Doyel | 112/169 |
| 4,060,044 | A | | 11/1977 | Kuramochi | 112/158 |
| 4,100,867 | A | | 7/1978 | Bass et al. | 112/270 |
| 4,475,473 | A | * | 10/1984 | Samoilov et al. | 112/80.04 |
| D331,761 | S | | 12/1992 | Hollinger | D15/69 |
| 5,178,083 | A | * | 1/1993 | Duret et al. | 112/277 |
| 5,520,128 | A | * | 5/1996 | Rich et al. | 112/277 |
| 5,669,318 | A | * | 9/1997 | Tsay et al. | 112/169 |
| 6,055,918 | A | * | 5/2000 | Hajjar et al. | 112/7 |

* cited by examiner

*Primary Examiner*—Danny Worrell
(74) *Attorney, Agent, or Firm*—Steven E. Kahm; Nikolai & Mersereau, P.A.

(57) ABSTRACT

A portable sewing machine powered by a battery can be used for carpet binding and other tasks. A pod having a motor and a battery are releasably attached to the side of the sewing machine and can be used on several different sewing machines such that only one pod need be purchased. The battery can be plugged into a plug on the pod to use a different battery while the first battery is being recharged. The battery-powered sewing machine can be on wheels for running on the floor for carpet binding, or it can be used in a stationary position. The portable sewing machine eliminates cords, which limit its use in carpet binding applications. The battery-powered sewing machine can operate in environments where no electricity is available such as in buildings under construction or sailboats needing sail repairs.

6 Claims, 2 Drawing Sheets

BATTERY-OPERATED SEWING MACHINE

BACKGROUND OF THE INVENTION

1. Field of the Invention

This invention relates to sewing machines and more particularly to battery operated portable sewing machines for commercial use.

2. Description of the Related Art

In the past sewing machines have been provided with power as a by use of a treadle, by electric motors or by belts running from a pulley connected to a power source. These power source requirements have dictated that the sewing machine remain in a fixed position or have cords attached which restrict or impede the movement of the sewing machine. There have been a few sewing machines having battery powered electric motors but these have been for small hand held hemming or light repair sewing machines meant for a few minutes of operation on light duty materials or for toys. There has never been a commercial battery powered portable sewing machine for heavy duty use on thick materials requiring a lot of power from a motor which is in near constant heavy duty use such as with carpet binding.

SUMMARY OF THE INVENTION

There are many uses for a battery operated portable sewing machine for continuous heavy duty use, such as for carpet binding, or sail making and sail repair on sail boats. These sewing machines are meant for running over long periods of time to compete a job and have the power to sew through thick materials. The motor used on the sewing machine is a high efficiency D.C. continuous duty motor. The battery and motor can come in a pod which is attached to the sewing machine as one unit, or the battery can be plugged in to the sewing machine to provide power to the motor. The battery can then be removed and recharged or replaced with a new or recharged battery.

Using a battery operated portable sewing machine the operator is free of cords and can operate the sewing machine along the edges of carpets without worrying about cord lengths, things getting in the way of the cord, or pulling on the cord and possibly unplugging the machine. A cordless battery operated sewing machine can operate in a building or other environment with no electrical power available. Further, without the cord the work environment is safer as nobody will trip on the cord.

OBJECTS OF THE INVENTION

It is an object of the invention to provide a portable sewing machine for commercial use on heavy material having a long duration of operation and a long life battery.

It is an object of the invention to provide an efficient powerful motor for long continuous duration runs on a job site.

It is an object of the invention to provide a battery and motor module for attachment to sewing machines and other portable equipment.

It is an object of the invention to provide the battery and motor in one pod, which can be attached to a sewing machine.

It is an object of the invention to provide a portable interchangeable battery for plugging into the pod containing the motor and the battery.

It is an object of the invention to provide an interchangeable motor and battery pod that will fit on one of any in a line of sewing machines or other tools.

Other objects, advantages and novel features of the present invention will become apparent from the following description of the preferred embodiments when considered in conjunction with the accompanying drawings.

DESCRIPTION OF THE PREFERRED EMBODIMENTS

Figure 1:
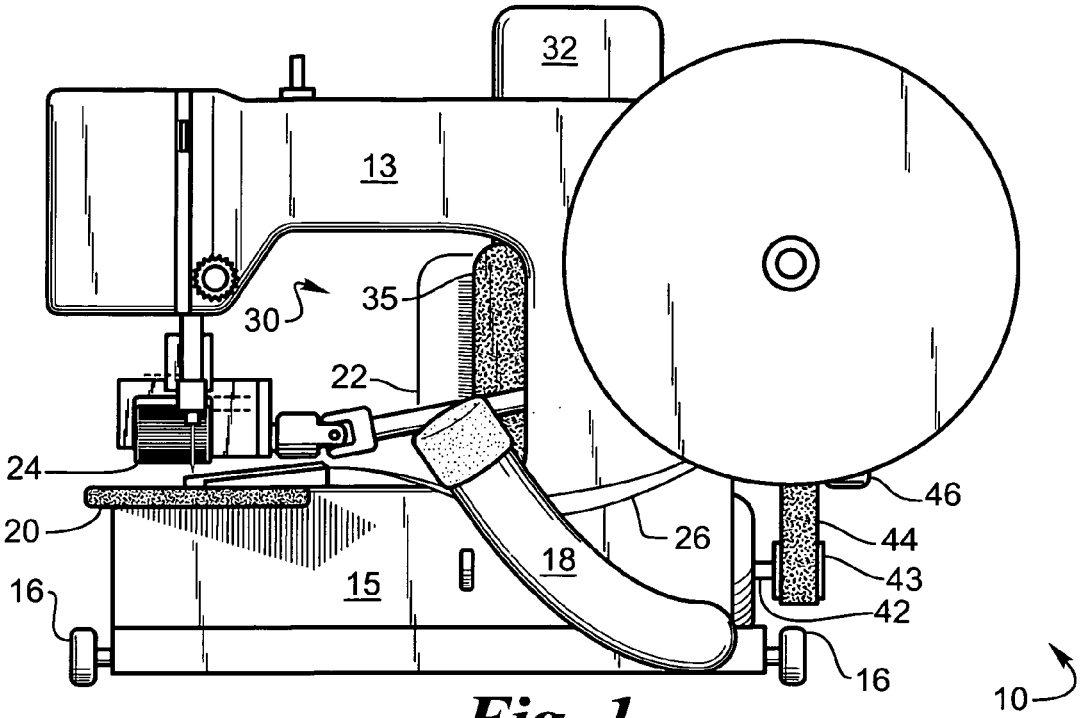
FIG. 1 is a first side perspective view of the sewing machine.

A portable sewing machine 10 having a housing 13 and a handle 18 for guiding the movement of the sewing machine is shown in FIG. 1. The sewing machine support 15 is mounded on wheels 16 to roll the sewing machine along the floor while sewing a carpet. The carpet rests in tabletop 20 and is pulled by roller 24 though the sewing machine 10. The handle 18 is used for guiding the sewing machine along the perimeter of the carpet. In the embodiment shown, thread 22 is used to sew binding tape 26 to the edge of a carpet.

In order to have a portable sewing machine 10 without power cords, which can get in the way and be awkward to use, a battery 32 is employed to provide power to a D.C. motor 40. The battery 32 and D.C. motor 40 are located on a pod 30 which can be easily attached or detached to the sewing machine 10 as needed. The pod 30 can be used on any of a number of tools including other sewing machines to reduce the cost of the machines by only needing one battery and motor pod to run one of any of the machines.

Figure 2:
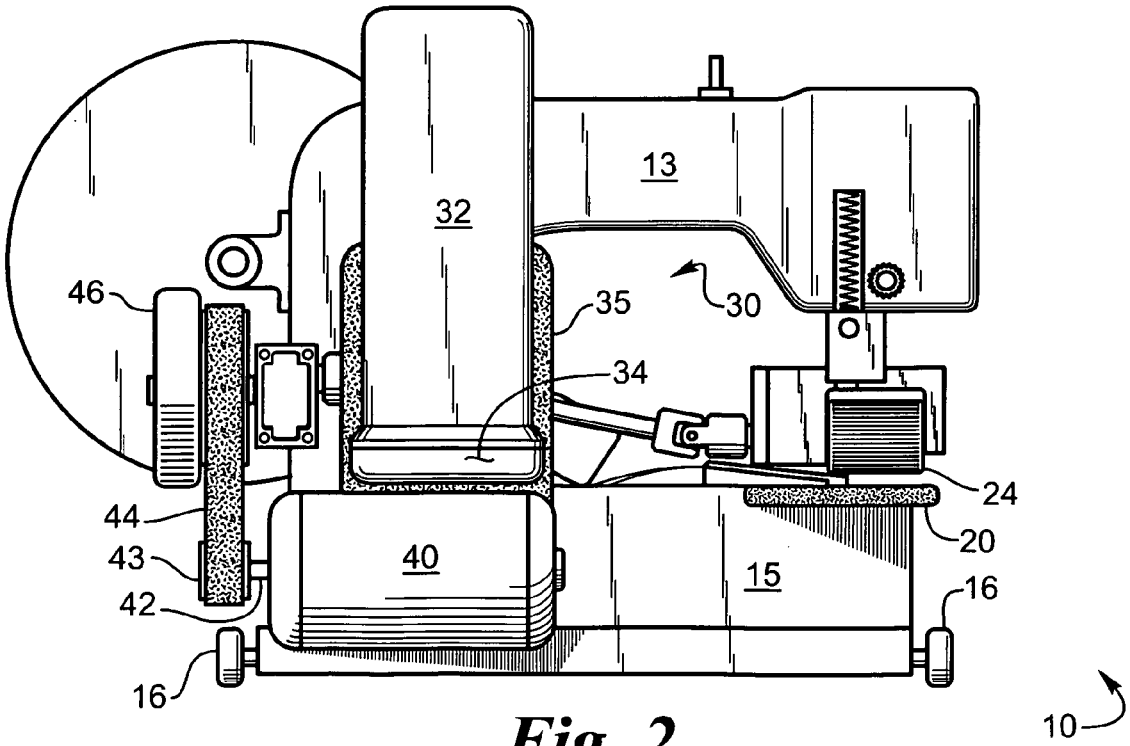
FIG. 2 is a second side perspective view of the sewing machine featuring the battery and motor pod.
Figure 3:
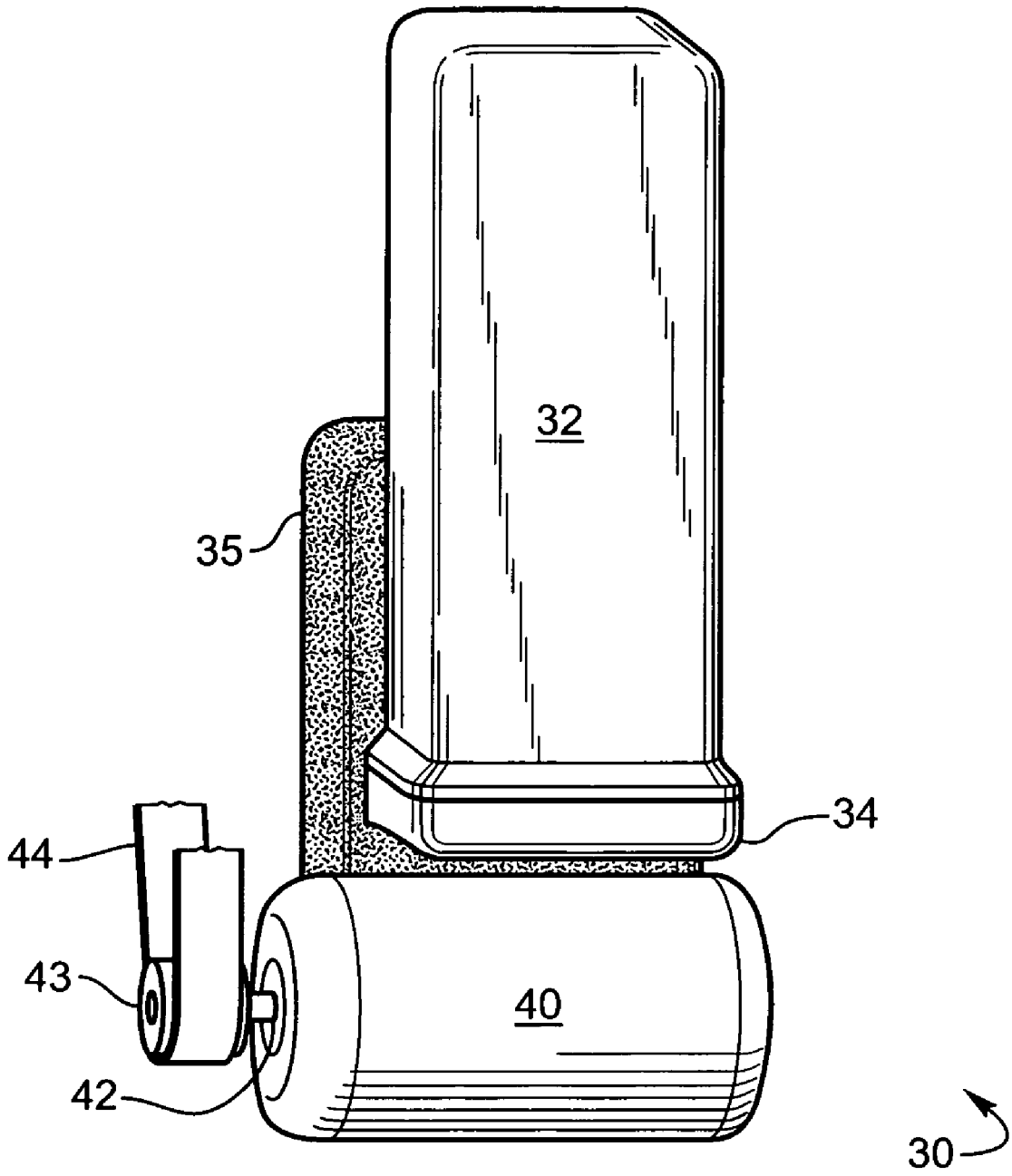
FIG. 3 is a perspective view of the pod having a battery and a motor.

FIG. 2 shows the reverse side of the sewing machine 10 and housing 13 with pod 30 installed. The pod 30 is shown in greater detail detached form the sewing machine 10 in FIG. 3. FIG. 3 shows the pod 30 with battery 32 plugged into a plug 34 attached to pod frame 35. Motor 40 is also attached to pod frame 35 and is electrically connected to the plug 34. The motor 40 is preferably an 18 volt D.C. motor which can be used for long durations and has a high efficiency for a low amperage draw on the battery. The motor 40 has a shaft 42 having a pulley 43, which engages a belt 44 for driving hand wheel 46 on shaft 48 of sewing machine 10. After installing the pod 30 on the sewing machine housing 13 the belt 44 is installed allowing the motor to power the sewing machine 10.

In an alternate embodiment the battery 32 can be removed from the plug 34 and a new battery 32 plugged in to continue operations with the sewing machine 10 without removing and replacing the entire pod 30. The battery 32 may be a rechargeable battery as is commonly used in drills and other hand tools.

Obviously, many modifications and variations of the present invention are possible in light of the above teachings. It is therefore to be understood that, within the scope of the appended claims, the invention may be practiced otherwise than as specifically described.

What is claimed is:

1. A portable sewing machine comprising, a housing enclosing and supporting a sewing machine, a second housing having only an electric motor and a battery attached, the second housing removeably attachable to the outside of the housing, a means for transmitting mechanical energy from the electric motor on the second housing to the sewing machine on the first housing.

2. A portable sewing machine as in claim 1 wherein, the second housing has a plug for plugging the battery therein.

3. A portable sewing machine as in claim 1 wherein, the housing has wheels for supporting the housing.

4. A portable sewing machine as in claim 3 wherein, the housing has a handle for guiding the sewing machine.

5. A portable sewing machine as in claim 4 wherein, the sewing machine has a roller for pulling on a material being sewn.

6. A portable sewing machine as in claim 5 wherein, the second housing has a plug for plugging the battery therein.

* * * * *